US005632263A

United States Patent [19]

Sartain

[11] Patent Number: 5,632,263

[45] Date of Patent: May 27, 1997

[54] AUTOMATIC ARROW POSITIONING DEVICE

[76] Inventor: John K. Sartain, 22131 Government Springs Rd., Montrose, Colo. 81401

[21] Appl. No.: 600,796

[22] Filed: Feb. 13, 1996

Related U.S. Application Data

[63] Continuation-in-part of Ser. No. 237,870, May 3, 1994, abandoned.

[51] Int. Cl.[6] ..... F41B 5/22

[52] U.S. Cl. ..... 124/44.5

[58] Field of Search ..... 124/23.1, 24.1, 124/25.6, 44.5, 86, 88

[56] References Cited

U.S. PATENT DOCUMENTS

| | | | |
|---|---|---|---|
| 2,975,780 | 3/1961 | Fisher | 124/24.1 |
| 3,504,659 | 4/1970 | Babington | 124/24.1 |
| 4,685,439 | 8/1987 | Cosentino | 124/44.5 |
| 4,803,971 | 2/1989 | Fletcher | 124/44.5 |
| 5,365,912 | 11/1994 | Pittmann | 124/44.5 |
| 5,394,858 | 3/1995 | Karolian | 124/44.5 |

*Primary Examiner*—John A. Ricci
*Attorney, Agent, or Firm*—Donald W. Erickson

[57] ABSTRACT

An automatic arrow positioning device for attachment to an archery bow. The device includes a V-shaped bale which is mounted rotatably within a generally semi-circular shaped housing. The housing is attached to a bracket which, in turn, is attached to the bow at, for example, the riser of the bow. One arm of the bale is attached to one end of an actuator. The other end of the actuator is attached to the inner end of a cable which extends to and is connected to the timing cables of the bow. Drawing of the bowstring causes the timing cables and actuator to pull the bale into correct position for the arrow to be shot.

2 Claims, 3 Drawing Sheets

AUTOMATIC ARROW POSITIONING DEVICE

This is a continuation-in-part of application Ser. No. 08/237,870, filed May 3, 1994, now abandoned the entire disclosure of which is incorporated herein by reference.

BACKGROUND OF THE INVENTION

This invention is directed at an arrow rest positioning device that automatically lifts and positions an arrow for shooting as the bow string is drawn. After the arrow is shot (released), the positioning member of the device automatically returns to its original position ready for the next arrow.

Arrow rest positioning devices currently in use require precise placement of an arrow on or between small wires or prongs. Therefore, the drawing of the arrow must be done very carefully to prevent the arrow from falling off the rest completely or falling between the rest and the bow riser. These same rest positioning devices usually require the arrow to remain in contact with the rest member for the full length of the arrow resulting in occasional fletch or hock contact therewith, which causes inaccuracy of the arrow shot. The present invention overcomes these and other problems of prior art arrow positioning devices.

SUMMARY OF THE INVENTION

The present invention provides an automatic arrow rest positioning device for attachment to an archery bow, generally attached to the riser of a compound bow, which precisely locates the arrow to an optimum shooting position consistently. The arrow positioning device of the present invention comprises a generally semi-circular or U-shaped housing mounted on a right angle bracket for attachment to a bow; a generally V-shaped bale having two arms which are rotatably mounted through the upright walls of the housing, one arm thereof also rotatably mounted or extending through the upright wall of the bracket; an actuating member, one end of which is attached to said arm that extends through the bracket upright wall; and a cable, one end of which is attached to the activating member and the other end thereof is attached to a cable slide mounted on the timing cable(s) of the bow. The bale can be provided with an anti-friction cover such as Teflon. The automatic arrow rest positioning device of the present invention is very useful in archery competition as well as archery hunting. It ensures that the arrow will be in optimum position for true flight.

DETAILED DESCRIPTION OF THE INVENTION

Figure 1:
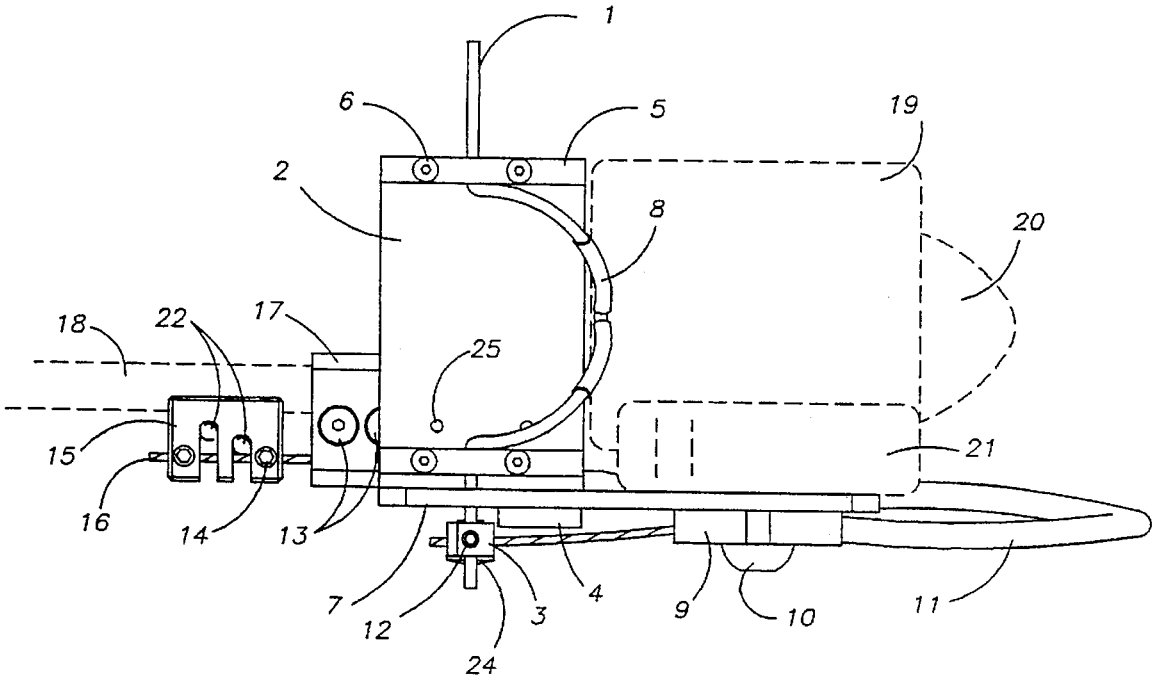
FIG. 1 is a top view of an automatic arrow rest positioning device of the present invention as it appears attached to the riser 21 of an archery bow.
Figure 2:
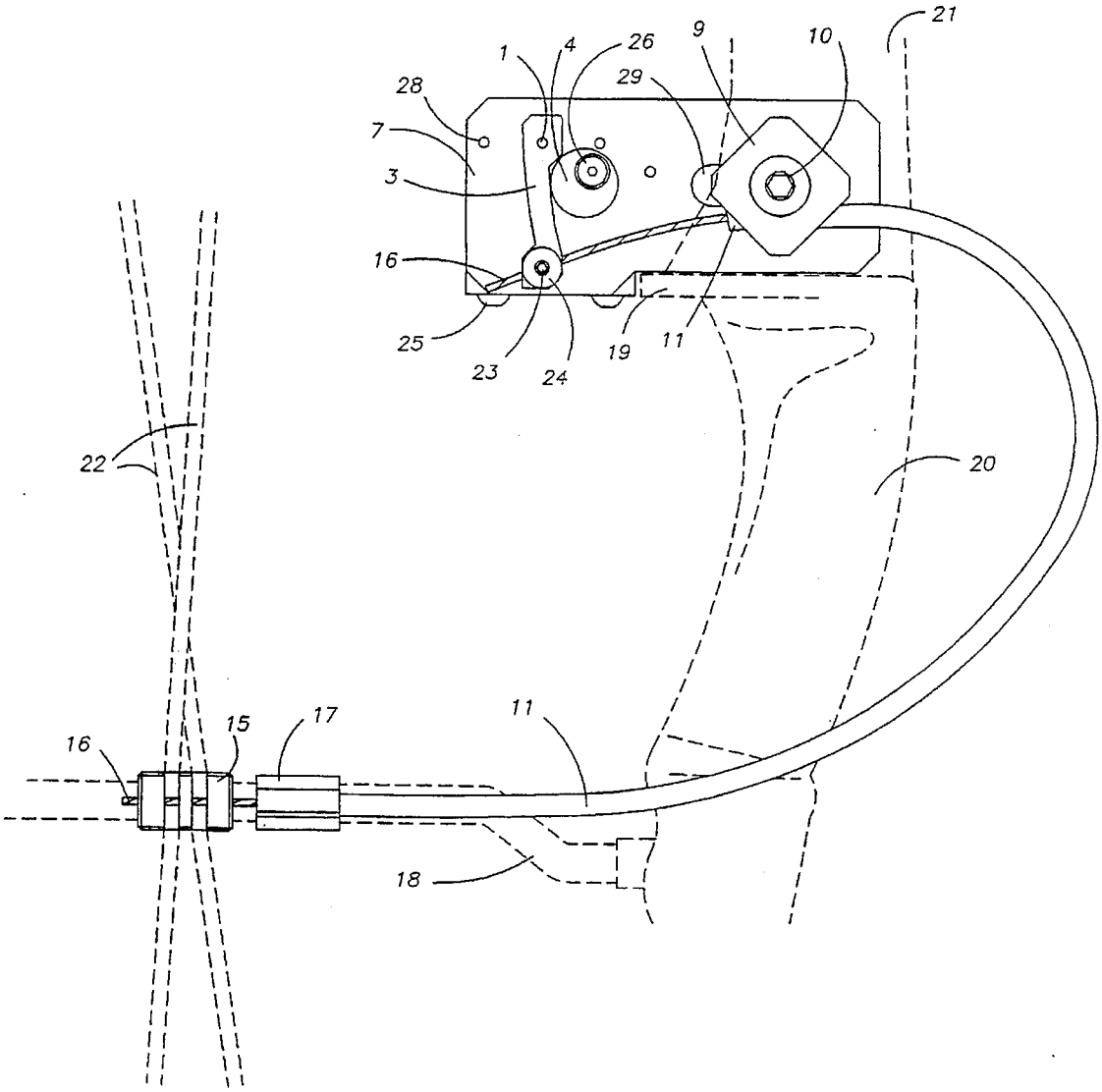
FIG. 2 is a side elevational view, right side, of the embodiment of FIG. 1.
Figure 3:
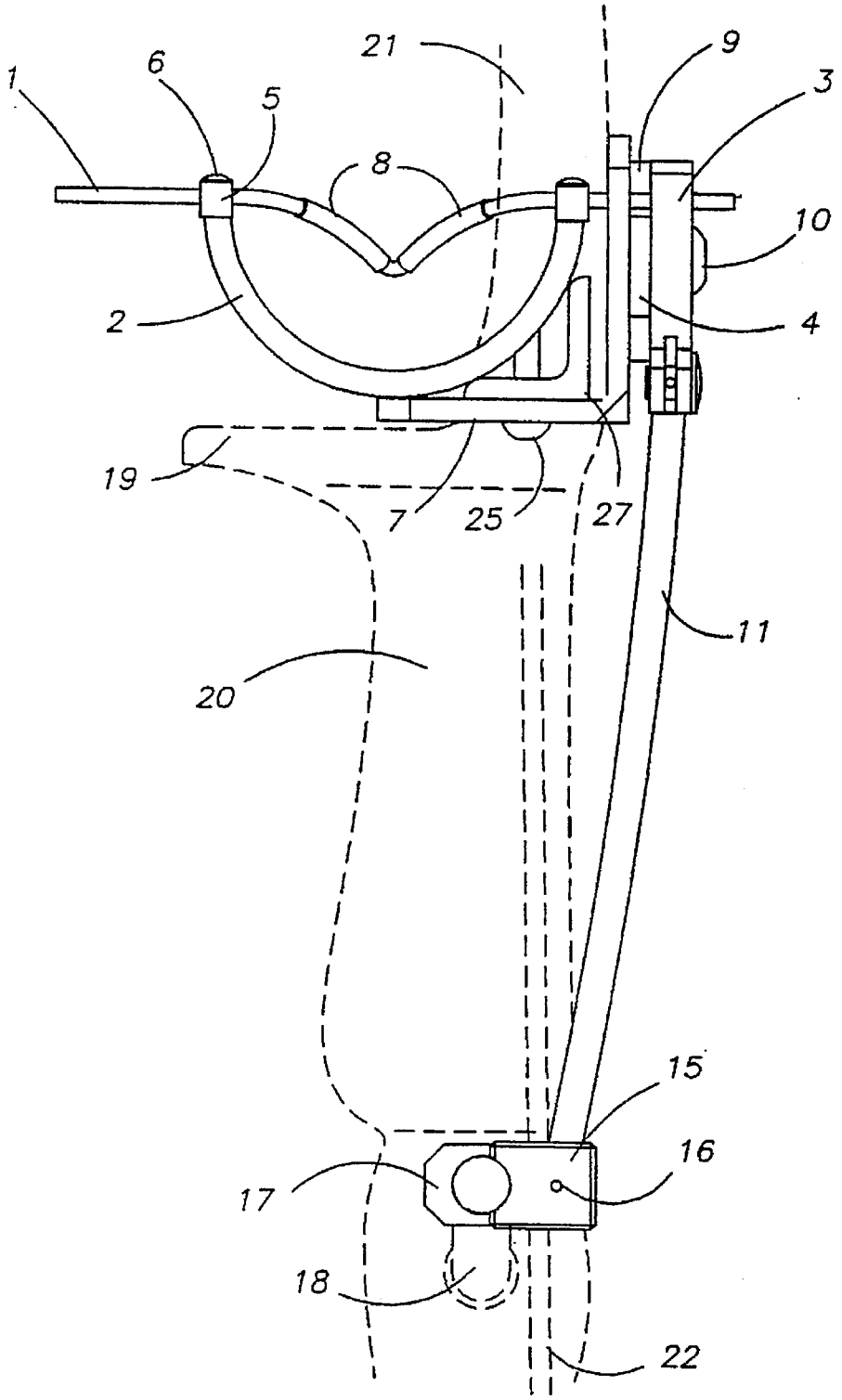
FIG. 3 is an end elevational view thereof.

With reference to the drawings, the automatic arrow rest positioning device of the present invention, as shown, includes a generally V-shaped bale 1, best seen in FIG. 3, having an outer first arm and a second inner arm extending horizontally. The arrow is placed and rests in the central (or bottom) of the V-shaped bale when the archer is ready to shoot. The bale 1 is rotatably mounted in a generally semi-circular shaped housing means made of a housing member 2 and a bearing member 5 at each upper end of the housing member, best seen in FIGS. 1 and 3. Each bearing member 5 is securely but detachably connected to housing member 2 using set screws 6. The bearing members are pre-drilled with openings to receive the first and second arms of the bale. The housing means is attached near its base, as by welding, to a right angle support 27 which, in turn, is slidably attached to the horizontal leg of a right angle bracket 7 using set screws 25. This provides, i.e. bracket 7 and support 27, secure and rugged attachment means for attaching the device to the bow. The horizontal leg of bracket 7 has two slots (not shown) which permit lateral adjustment of support 27 and hence, lateral adjustment of the housing means. The upright leg of bracket 7 is provided with one or more openings 28 (see FIG. 2) which align with openings in bearing member 5 to receive the inner arm of bale 1. The bracket 7 also has one or more slots 29 through which bolt 10 can extend for attachment of the bracket to bow riser 21. The slot(s) 29 permit lateral adjustment of the bracket. To the inner arm of bale 1, which extends through bearing member 5 and bracket 7, is affixed a generally rectangular bar actuating member 3 at one end thereof using a set screw 12 or the like. An adjustable actuating member stop 4 (see FIG. 2) is adjacent to activating member 3 and attached to top bracket 7 using set screw 26 to limit the movement of member 3. To the other end of actuating member 3 is attached a rotatable cable clamp 24 using a set screw 23 (see FIG. 2) to which is securely attached the inner end of wire cable 16. The other end (outer end) of cable 16 which passes through cable conduit 11 is securely connected to a timing cable slide 15 using set screws 14 (see FIG. 1). Conduit 11, at its inner end, is securely held in place by clamp washer 9 (grooved on its back side to accommodate the contour of the conduit) which is held in place by bolt 10 or the like (best seen in FIG. 2). Conduit 11, at its outer end, is clamped to cable guard bar 18 using, for example, cable slide stop 17 with set screws 13 or the like. This enables smooth travel of cable 16 directly responsive to the movement of actuating member 3 and timing cables 22. In practice, an arrow is placed in the bottom of the V-shaped bale and nocked against the bowstring. As the string is drawn, the timing cables cause cable 16 to actuate member 3 which causes bale 1 to correctly position the arrow for shooting. After the arrow is released, the reverse actions automatically take place to return the bale for receiving and positioning the next arrow.

The bale 1 is preferably covered, at least at the central portion of the V, with an anti-friction material 8 such as Teflon, low molecular weight polyethylene, or the like. The bracket, housing means, and actuating member can be made of metal such as cast aluminum, or the like. The bale should be made of a high quality metal such as stainless steel. The conduit 11 is made of a smooth plastic such as Teflon or a waxy polyethylene to facilitate uninhibited movement of cable 16.

The bow riser 21, bow shelf 19 and bow handle 20 shown in broken lines are for illustration only.

What is claimed is:

1. An automatic arrow positioning device for attachment to an archery bow having a riser, a bow string, timing cables, and a cable guard bar, said bowstring and riser defining a bow plane along which an arrow is expelled, said arrow positioning device for automatically supporting said arrow in a shooting path in said bow plane when the bow is drawn, comprising:

a housing member, said housing member including two upwardly extending sections, one on each side of said bow plane; a bearing means at the upper end of each upwardly extending section, said bearing means located at approximately the height of said shooting path, and in a plane perpendicular to said bow plane;

a bracket means for attaching said housing member to the bow, said bracket means including a generally vertical plate for attachment to a side of said bow riser, said bracket means including an aperture in line with said bearing means;

an arrow supporting bale means, having a central generally V-shaped section for receiving an arrow, and first and second generally horizontal sections, one on each side of the central section, each horizontal section pivotally supported in a respective bearing means, and said second horizontal section additionally passing through said aperture in said plate;

an activating member having first and second ends, said second horizontal section of said bale means, after passing through said aperture in said plate, anchored to a first end of said activating member;

an actuating cable having first and second ends, a first end of said actuating cable being connected to the second end of said activating means, and a second end of said actuating cable being connected to the timing cables;

whereby, as the bowstring is drawn, the timing cables will move, and such movement will be transmitted through the actuating cable to the bale, causing the V-shaped section to rotate upward to support an arrow in the shooting path, and when the bowstring is released, the V-shaped section will rotate downward to avoid contact with the arrow as it is released.

2. The device according to claim 1 wherein the actuating cable passes through a cable conduit having first and second ends, the first end of said conduit being attached to said bracket means, and the second end of said conduit being attached to said cable guard bar.

* * * * *